US011242733B2

(12) United States Patent
Conrad

(10) Patent No.: US 11,242,733 B2
(45) Date of Patent: Feb. 8, 2022

(54) METHOD AND APPARATUS FOR PRODUCING WELL WITH BACKUP GAS LIFT AND AN ELECTRICAL SUBMERSIBLE WELL PUMP

(71) Applicant: Baker Hughes Oilfield Operations LLC, Houston, TX (US)

(72) Inventor: Caleb Marchant Conrad, Anchorage, AK (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/996,234

(22) Filed: Aug. 18, 2020

(65) Prior Publication Data

US 2021/0102450 A1 Apr. 8, 2021

Related U.S. Application Data

(60) Provisional application No. 62/890,867, filed on Aug. 23, 2019.

(51) Int. Cl.
*E21B 43/12* (2006.01)
*E21B 47/06* (2012.01)

(52) U.S. Cl.
CPC ..... *E21B 43/128* (2013.01); *E21B 43/1235* (2020.05); *E21B 47/06* (2013.01)

(58) Field of Classification Search
CPC ..... E21B 43/12; E21B 43/123; E21B 43/128
See application file for complete search history.

(56) References Cited

U.S. PATENT DOCUMENTS

| | | | | |
|---|---|---|---|---|
| 6,009,945 | A | 1/2000 | Ricks | |
| 6,138,758 | A * | 10/2000 | Shaw | B04C 5/00 166/265 |
| 6,167,965 | B1 * | 1/2001 | Bearden | F04D 9/002 166/250.15 |
| 7,954,551 | B2 | 6/2011 | Bolding | |
| 8,631,875 | B2 | 1/2014 | Nguyen et al. | |
| 2003/0141073 | A1 * | 7/2003 | Kelley | E21B 43/305 166/372 |
| 2004/0060705 | A1 | 4/2004 | Kelley | |
| 2005/0230121 | A1 * | 10/2005 | Martinez | E21B 43/122 166/372 |

(Continued)

OTHER PUBLICATIONS

International Search Report and Written Opinion of PCT Application No. PCT/US2020/047318 dated Nov. 30, 2020: pp. 1-12.

*Primary Examiner* — Shane Bomar
(74) *Attorney, Agent, or Firm* — Bracewell LLP; Keith Derrington

(57) ABSTRACT

A well production method uses side gas lift valves above a packer and an ESP below the packer. In a gas lift mode, a controller turns the ESP motor off, and shifts a tubing valve below the packer to a gas lift position while flowing gas down the casing. While in the gas lift mode, a pressure gauge monitors motor lubricant pressure, which correlates with a flowing bottom hole pressure of the well fluid in the lower casing annulus. In an ESP mode, the controller stops the flow of gas from the gas source, shifts the tubing valve to an ESP position and turns on the motor, causing well fluid to flow through the pump intake. The pressure gauge continues to monitor the lubricant pressure during the ESP mode.

18 Claims, 2 Drawing Sheets

(56) References Cited

U.S. PATENT DOCUMENTS

| | | | | |
|---|---|---|---|---|
| 2006/0076145 | A1* | 4/2006 | Lembcke | E21B 41/0078 166/372 |
| 2008/0141826 | A1* | 6/2008 | Marya | C22C 38/001 75/331 |
| 2012/0211239 | A1 | 8/2012 | Kritzler et al. | |
| 2016/0017701 | A1 | 1/2016 | Tanner et al. | |
| 2016/0265333 | A1* | 9/2016 | Roth | E21B 43/122 |
| 2018/0163526 | A1 | 6/2018 | Chidi et al. | |
| 2019/0078421 | A1 | 3/2019 | Oliphant | |
| 2019/0204467 | A1* | 7/2019 | Curt | E21B 47/10 |
| 2021/0140290 | A1* | 5/2021 | Eslinger | F04D 13/10 |

* cited by examiner

METHOD AND APPARATUS FOR PRODUCING WELL WITH BACKUP GAS LIFT AND AN ELECTRICAL SUBMERSIBLE WELL PUMP

CROSS REFERENCE TO RELATED APPLICATION

This application claims priority to provisional application Ser. No. 62/890,867, filed Aug. 23, 2019.

FIELD OF DISCLOSURE

The present disclosure relates to wells having artificial lift with an electrical submersible well pump (ESP) having a backup gas lift system, the ESP having a downhole gauge used to optimize production rates.

BACKGROUND

Electrical submersible pumps (ESP) are commonly used in hydrocarbon producing wells. An ESP includes a pump driven by an electrical motor. The pump is often a centrifugal pump having impellers rotated by a shaft assembly extending from the motor. Pressure gauges may be mounted in the ESP to monitor intake and discharge pressures.

Another artificial lift method is referred to as a gas lift system. The production tubing has side pocket mandrels containing wireline deployed gas lift valves that will admit flow from the casing annulus into the tubing. Well fluid flows through casing perforations into the tubing. The operator pumps gas down the casing annulus, which flows through the gas lift valves into the tubing, decreasing the density of the production fluid flowing up the tubing to lower the flowing bottom hole pressure of the well fluid at the bottom of the tubing.

SUMMARY

A method of producing a well having a casing with perorations comprises lowering into the casing a string of production tubing containing a side pocket mandrel having a gas lift valve, a packer below the side pocket mandrel, a tubing valve below the packer, and an electrical submersible pump assembly (ESP) below the tubing valve. The ESP has a pump driven by a motor and a pressure gauge mounted to the motor. The method includes setting the packer in the casing above the perforations, defining a lower sealed end of an upper casing annulus and an upper sealed end of a lower casing annulus. A controller at an upper end of the well connects to the ESP, the pressure gauge, and the tubing valve. A gas source at the upper end of the well communicates with the upper casing annulus.

The controller selectively produces the well in a gas lift mode by shutting off the motor and shifting the tubing valve to a gas lift position, allowing well fluid to flow from the perforations up the lower casing annulus around the ESP through the tubing valve and into the tubing. The controller causes gas to flow from the gas source down the upper casing annulus through the gas lift valve into the production tubing to lower the density of the well fluid flowing up the production tubing. While in the gas lift mode the controller and the pressure gauge monitor a flowing bottom hole pressure of the well fluid in the lower casing annulus.

In response to lowering of the flowing bottom hole pressure being monitored, the controller shifts to an ESP mode, stopping the flow of gas from the gas source, shifting the tubing valve to an ESP position and turning on the motor, causing well fluid to flow from the perforations through a pump intake and the tubing valve into and up the production tubing. The controller continues to monitor the flowing bottom hole pressure in the lower casing annulus using the pressure gauge.

The motor is filled with a dielectric lubricant, and the ESP has a pressure equalizer that reduces a pressure differential between the lubricant and well fluid in the lower casing annulus. In the embodiment shown and described, the pressure gauge directly senses a lubricant pressure of the lubricant, which correlates with the flowing bottom hole pressure. The pressure gauge communicates the lubricant pressure to the controller both while in the gas lift mode and the ESP mode.

In the embodiment shown, lowering the assembly into the casing further comprises deploying a power cable from the controller alongside the production tubing and through the packer to the motor for supplying power to the motor. The pressure gauge superimposes a signal corresponding to the lubricant pressure on the power cable.

While in the gas lift mode, the tubing valve closes a lower end of the tubing from a discharge of the pump and opens access of well fluid in the lower casing annulus to the lower end of the tubing. While in the ESP mode, the tubing valve opens the lower end of the tubing to the discharge of the pump and prevents well fluid in the lower annulus from bypassing the intake of the pump and flowing directly into the lower end of the tubing.

The controller switches between the gas lift mode and the ESP mode based on the flowing bottom hole pressure sensed by the pressure gauge.

In the embodiment shown, a discharge pressure gauge mounts between the pump and the tubing valve. During the ESP mode, the discharge pressure gauges senses a discharge pressure of the pump and communicates the discharge pressure to the controller. In response, the controller, controls a speed of the motor.

Figure 1A:
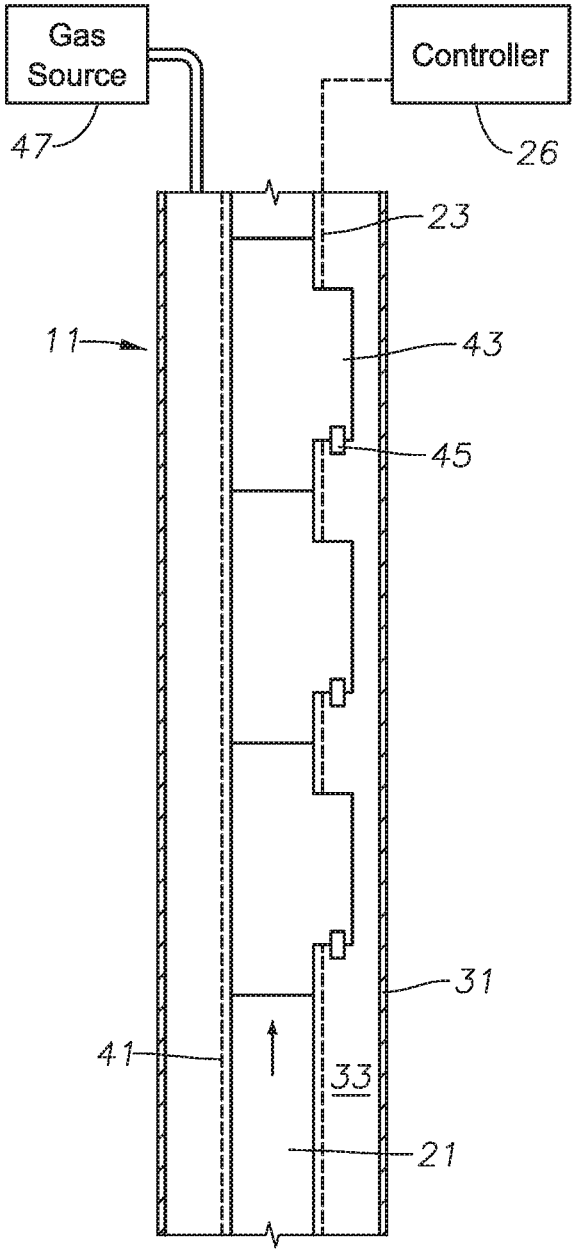
FIGS. 1A and 1B comprises a schematic view of a well having an ESP with a gas lift back up, and showing the ESP operating with the gas lift turned off.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about"

includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
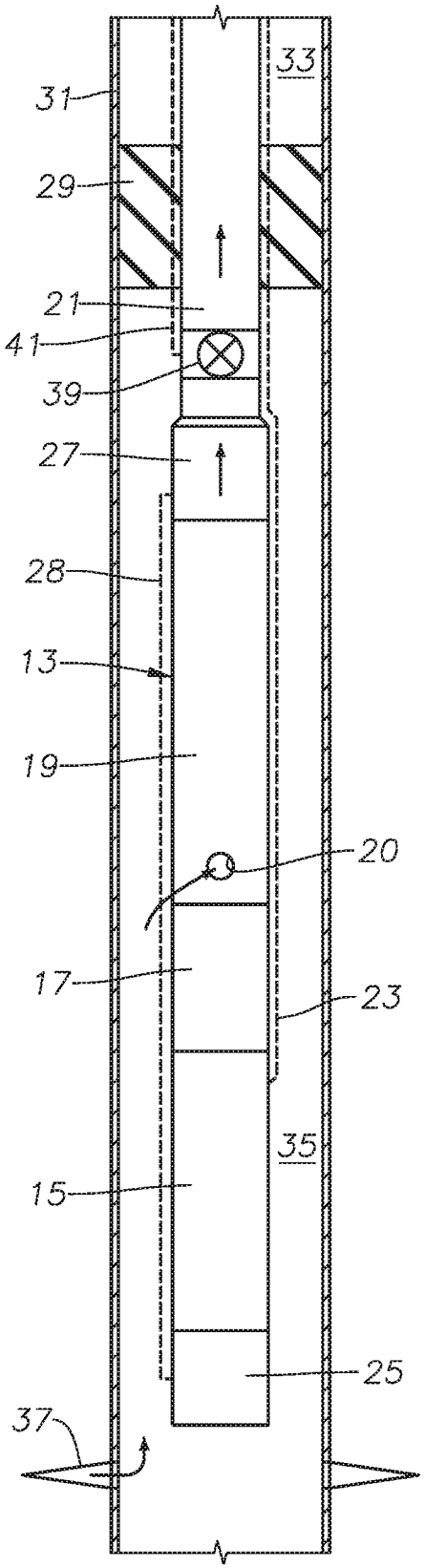

FIG. 1B illustrates casing 11 of a well having an electrical submersible well pump (ESP) 13 of a type commonly used to lift hydrocarbon production fluids from wells. The terms "upward", "downward", "above", "below" and the like are used only for convenience as ESP 13 may be operated in other orientations, such as inclined and horizontal. ESP 13 has an electrical motor 15 coupled by a seal section 17 to a centrifugal pump 19. Pump 19 has an intake port 20 that may be at the lower end of pump 19, in a separate module, or in an upper part of seal section 17. If a gas separator (not shown) is employed, intake port 20 would be in the gas separator.

Motor 15 contains a dielectric motor lubricant for lubricating the bearings within. A pressure equalizer communicates with the lubricant in motor 15 and with the well fluid for reducing a pressure differential between the lubricant in motor 15 and the exterior well fluid. In this example, the pressure equalizer is a part of seal section 17. Alternately, the pressure equalizer could be located below motor 15, and other portions of seal section 17 could be above motor 15.

A string of production tubing 21 extending downward from a wellhead (not shown) supports ESP 13. Pump 19 discharges well fluid into production tubing 21. A power cable 23 extends downward alongside production tubing 21 and has a motor lead on its lower portion that connects to motor 15.

In this embodiment, a motor gauge unit 25 secures to the bottom of motor 15. Motor gauge unit 25 has a pressure gauge for measuring parameters of the motor lubricant, such as pressure and temperature. Because of the pressure equalizer, the pressure of the motor lubricant will be substantially the same as and correlate with the flowing bottom hole pressure surrounding motor 15, thus motor gauge unit 25 may be considered to be a flowing bottom hole pressure gauge adjacent the bottom of production tubing 21. Signals from motor gauge unit 25 may be transmitted to a controller 26 (FIG. 1A) adjacent the wellhead by a separate instrument wire or by superimposing those signals on the motor windings within motor 15 and on power cable 23.

A discharge gauge unit 27 optionally may be mounted to the upper end of pump 19. Discharge gauge unit 27 has sensors that sense the discharge pressure of the well fluid being pumped by pump 19. The signals from discharge gauge unit 27 may be transmitted down to motor gauge unit 25 on a signal line 28 for communication with controller 26 along with the signals from motor gauge unit 25. Alternately, the signals from discharge gauge unit 27 could be transmitted up a separate instrument wire to controller 26. Controller 26 optionally may include a variable speed drive unit that controls the speed of motor 15 in response to the discharge pressure.

A packer 29, normally run with production tubing 21 and ESP 13, sets and seals to casing 31 of well 11. Once set, packer 29 divides the interior of casing 31 into an upper casing annulus 33 surrounding production tubing 21 and a lower casing annulus 35 surrounding ESP 13. Perforations 37 in casing 31 allow the flow of well fluid into a lower portion of lower casing annulus 35. Power cable 23 extends through packer 29 via a sealed penetrator.

A tubing valve or drain valve 39 mounts in tubing 21 above pump 27 and below packer 29. Drain valve 39 could be located in one branch of a Y-tube (not shown). Drain valve 39 has a first or ESP mode position while in an ESP mode that allows flow from pump 27 up production tubing 21. Drain valve 39 has a second position or gas lift position while in a gas lift mode that blocks communication of pump 19 with production tubing 21 and also opens communication between lower casing annulus 35 and production tubing 21. Drain valve 39 may be of a variety of types, including a sliding sleeve type. In this example, a drain valve control line 41 extends from drain valve 29 through packer 29 and upper casing annulus 33 to controller 26. Drain valve control line 41 may be a hydraulic or electrical line.

FIG. 1A schematically shows a number of side pocket mandrels 43 mounted in production tubing 21. Side pocket mandrels 43 are conventional, each having a pocket that protrudes laterally from production tubing 21 and contains a retrievable gas lift valve 45. Gas lift valves 45 may be retrieved and installed in mandrels 43 by lowering on a wireline tool through production tubing 21. Gas lift valves 45 block any outward flow of fluid within production tubing 21 to upper casing annulus 33. Gas lift valves 45 will admit into production tubing 21 gas in upper casing annulus 33 if the upper casing annulus pressure is sufficiently higher than the pressure within production tubing 21. The gas is selectively supplied to upper casing annulus 33 by a gas source 47 located at the surface. Gas source 47 may utilize gas produced by well 11 and/or other sources. Gas source 47 may include a compressor.

Well 11 will be configured as shown in FIGS. 1A and 1B by connecting ESP 13, drain valve 39 and packer 29 to the lower end of production tubing 21, which has a number of side pocket mandrels 43. The operator lowers the assembly into casing 31 to a desired depth, then sets packer 29.

Figure 2A:
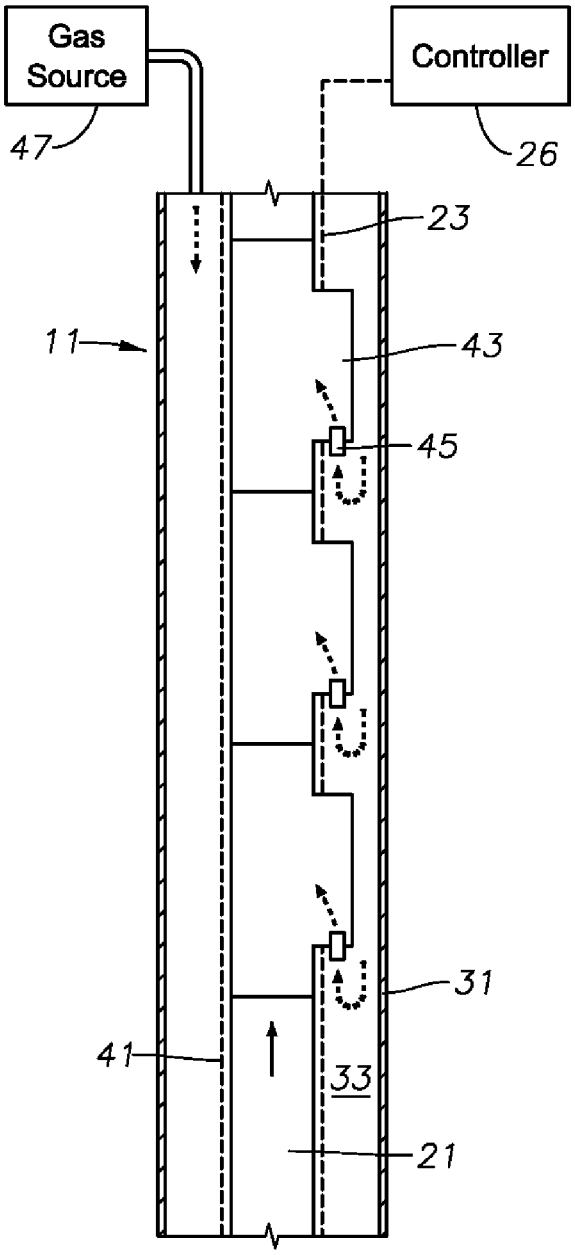
FIGS. 2A and 2B illustrate the well of FIG. 1 with the gas lift operating and the ESP turned off.
Figure 2B:
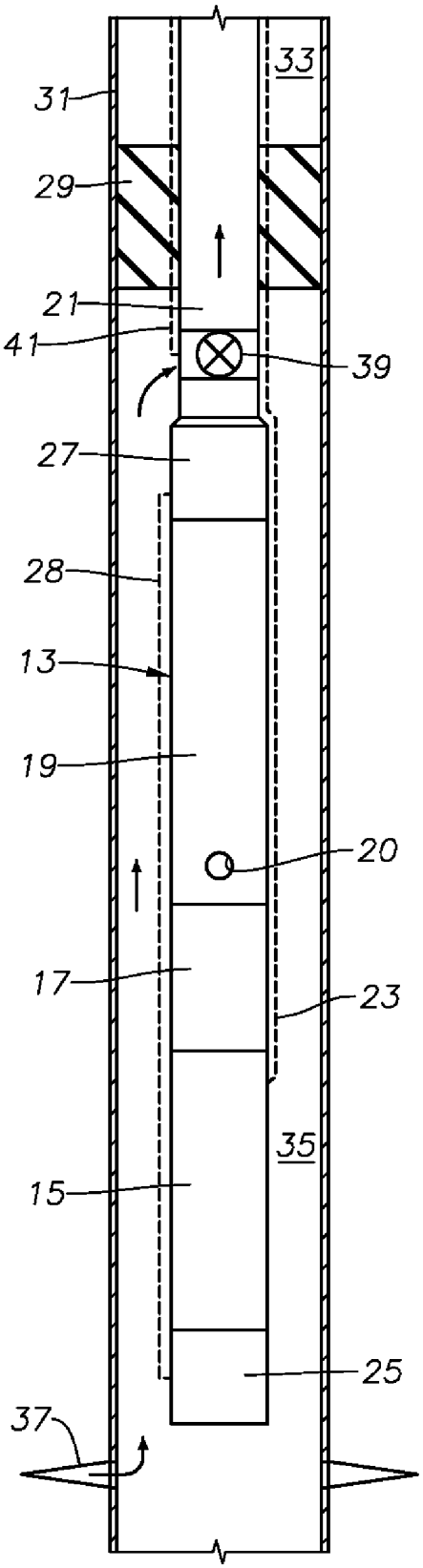

Production can be done initially either in the ESP mode (FIGS. 1A and 1B) or in the gas lift mode (FIGS. 2A and 2B). Assuming that it is in ESP mode, controller 26 will place drain valve 39 in the ESP mode position, shut off gas source 47, and turn on motor 15. Well fluid, shown by the solid line arrows, flows from perforations 37 into pump intake 20 and up production tubing 21. At the same time, controller 26 monitors the flowing bottom hole pressure in the lower portion of lower casing annulus 35 by receiving signals indicating lubricant pressure from motor gauge 25. If employed, controller 26 also monitors the discharge pressure of pump 19 via discharge pressure gauge 27 and controls the speed of motor 15 in response.

If various conditions sensed, including the pressure measured by motor gauge 25, indicate that production would be improved by switching to the gas lift mode, controller 26 will automatically switch to the gas lift mode. For example, the controller may determine that the flowing bottom hole pressures has lowered beyond a selected minimum. When switching to the gas lift mode, controller 26 will automatically shut down motor 15, change drain valve 39 to the gas lift position and began communicating gas under pressure from gas source 47 into upper casing annulus 33. This results in well fluid flowing from perforations 37 up lower casing annulus 35 and through drain valve 39 into production tubing 21. The gas pressure applied to upper casing annulus 33 enters gas lift valves 45 as indicated by the dotted arrows. The gas mixes with the production fluid in production tubing 21 to lower the density and lower the flowing bottom hole pressure. With motor gauge 25, controller 26 will continue to monitor the flowing bottom hole pressure in the lower portion of lower casing annulus 35. Changes in the conditions sensed can causes controller 26 to continue to shift back and forth between the gas lift mode and the ESP mode.

The present disclosure described herein, therefore, is well adapted to carry out the objects and attain the ends and advantages mentioned, as well as others inherent therein. While one embodiment of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A method of producing a well having a casing with perforations, comprising:

lowering into the casing a string of production tubing containing a side pocket mandrel having a gas lift valve, a packer below the side pocket mandrel, a tubing valve below the packer, and an electrical submersible pump assembly (ESP) below the tubing valve, the ESP having a pump driven by a motor and a pressure gauge mounted to the motor;

setting the packer in the casing above the perforations, defining a lower sealed end of an upper casing annulus and an upper sealed end of a lower casing annulus;

connecting a controller at an upper end of the well to the ESP, the pressure gauge, and the tubing valve;

connecting a gas source at the upper end of the well to the upper casing annulus;

with the controller, selectively producing the well in a gas lift mode by shutting off the motor and shifting the tubing valve to a gas lift position, allowing well fluid to flow from the perforations up the lower casing annulus around the ESP through the tubing valve and into the production tubing, and flowing gas from the gas source down the upper casing annulus through the gas lift valve into the production tubing to lower the density of the well fluid flowing up the production tubing;

while in the gas lift mode and with the controller and the pressure gauge, monitoring a flowing bottom hole pressure of the well fluid in the lower casing annulus;

in response to a change in the flowing bottom hole pressure monitored by the pressure gauge and the controller, switching from the gas lift mode to an ESP mode by stopping the flow of gas from the gas source, shifting the tubing valve to an ESP position and turning on the motor, causing well fluid to flow from the perforations through a pump intake and the tubing valve into and up the production tubing; and while in the ESP mode, monitoring the flowing bottom hole pressure in the lower casing annulus with the pressure gauge and the controller.

2. The method according to claim 1, wherein:

the motor is filled with a dielectric lubricant, and the ESP has a pressure equalizer that reduces a pressure differential between the lubricant and well fluid in the lower casing annulus;

the pressure gauge directly senses a lubricant pressure of the lubricant, which correlates with the flowing bottom hole pressure; and the pressure gauge communicates the lubricant pressure to the controller both while in the gas lift mode and the ESP mode.

3. The method according to claim 2, wherein:

lowering into the casing further comprises deploying a power cable from the controller alongside the production tubing and through the packer to the motor for supplying power to the motor; and wherein the pressure gauge superimposes a signal corresponding to the lubricant pressure on the power cable.

4. The method according to claim 1, wherein while in the gas lift mode, the tubing valve closes a lower end of the production tubing from a discharge of the pump and opens access of well fluid in the lower casing annulus to the lower end of the production tubing.

5. The method according to claim 4, wherein while in the ESP mode, the tubing valve opens the lower end of the production tubing to the discharge of the pump and prevents well fluid in the lower casing annulus from bypassing the intake of the pump and flowing directly into the lower end of the production tubing.

6. The method according to claim 1, wherein the controller automatically switches between the gas lift mode and the ESP mode based on changes in the bottom hole pressure sensed by the pressure gauge.

7. The method according to claim 1, further comprising:

mounting a discharge pressure gauge between the pump and the tubing valve;

during the ESP mode, sensing a discharge pressure of the pump with the discharge pressure gauge and communicating the discharge pressure to the controller; and with the controller, controlling a speed of the motor in response to the discharge pressure.

8. A method of producing a well having a casing with perforations, comprising:

lowering into the casing a string of production tubing containing side pocket mandrels, each having a gas lift valve, a packer below the side pocket mandrels, a tubing valve below the packer, and an electrical submersible pump assembly (ESP) below the tubing valve, the ESP having a pump with an intake, a motor containing a dielectric lubricant, a pressure equalizer that reduces a pressure differential between the lubricant and well fluid on an exterior of the motor, and a pressure gauge mounted to the motor that senses pressure of the lubricant;

setting the packer in the casing, defining a lower sealed end of an upper casing annulus and an upper sealed end of a lower casing annulus;

connecting a controller at an upper end of the well to the ESP and to the tubing valve;

connecting a gas source at the upper end of the well to the upper casing annulus;

with the controller, selectively producing the well in a gas lift mode by shutting off the motor and shifting the tubing valve to a gas lift position, which allows well fluid to flow from the perforations up the lower casing annulus around the pump through the tubing valve and into the production tubing, and flowing gas from the gas source down the upper casing annulus, which flows through the gas lift valves into the production tubing to lower the density of in the well fluid flowing up the production tubing;

while in the gas lift mode, monitoring the lubricant pressure with the pressure gauge, which correlates with a flowing bottom hole pressure of the well fluid in the lower casing annulus, and sending signals to the controller in response;

in response to a reduction of the flowing bottom hole pressure determined by the controller, switching from the gas lift mode to an ESP mode by stopping the flow of gas from the gas source, shifting the tubing valve to an ESP position and turning on the motor, causing well fluid to flow from the perforations through the pump intake and the tubing valve into and up the production tubing; and with the controller and the pressure gauge during the ESP mode, monitoring the lubricant pressure and correlating the lubricant pressure to the flowing bottom hole pressure in the lower casing annulus.

9. The method according to claim 8, wherein lowering into the casing further comprises:

deploying a power cable from the controller alongside the production tubing and through the packer to the motor for supplying power to the motor; and wherein the pressure gauge superimposes signals corresponding to the lubricant pressure on the power cable.

10. The method according to claim 8, further comprising:

mounting a discharge pressure gauge between the pump and the tubing valve;

during the ESP mode, sensing a discharge pressure of the pump with the discharge pressure gauge and communicating the discharge pressure to the controller; and with the controller, controlling a speed of the motor in response to the discharge pressure.

11. The method according to claim 8, wherein while in the gas lift mode, the tubing valve closes a lower end of the production tubing from a discharge of the pump and opens access of well fluid in the lower casing annulus to the lower end of the production tubing.

12. The method according to claim 11, wherein while in the ESP mode, the tubing valve opens the lower end of the production tubing to the discharge of the pump and prevents well fluid in the lower casing annulus from bypassing the intake of the pump and flowing directly into the lower end of the production tubing.

13. An assembly for producing a well having a casing with perforations, comprising:

a string of production tubing containing a side pocket mandrel having a gas lift valve, a packer below the side pocket mandrel, a tubing valve below the packer, and an electrical submersible pump assembly (ESP) below the tubing valve, the ESP having a pump driven by a motor and a pressure gauge mounted to the motor;

the packer being set in the casing above the perforations, defining a lower sealed end of an upper casing annulus and an upper sealed end of a lower casing annulus;

a controller at an upper end of the well that is in electrical communication with the motor, the pressure gauge, and the tubing valve;

a gas source at the upper end of the well that communicates with the upper casing annulus;

the assembly having a gas lift mode with the motor off and the tubing valve in a gas lift position that allows well fluid to flow from the perforations up the lower casing annulus around the ESP through the tubing valve and into the production tubing, and the gas source is flowing gas down the upper casing annulus through the gas lift valve into the production tubing to lower the density of the well fluid flowing up the production tubing;

the controller receiving signals from the pressure gauge while in the gas lift mode, which correlate to a flowing bottom hole pressure of the well fluid in the lower casing annulus;

the assembly having an ESP mode wherein in response to a change in the flowing bottom hole pressure, the controller stops the flow of gas from the gas source into the upper casing annulus ceases, shifts the tubing valve to an ESP position and turns on the motor, causing well fluid to flow from the perforations through a pump intake and the tubing valve into and up the production tubing; and while in the ESP mode, the controller monitors the flowing bottom hole pressure in the lower casing annulus in response to signals from the pressure gauge.

14. The assembly according to claim 13, wherein:

the motor is filled with a dielectric lubricant, and the ESP has a pressure equalizer that reduces a pressure differential between the lubricant and well fluid in the lower casing annulus;

the pressure gauge directly senses a lubricant pressure of the lubricant, which correlates with the flowing bottom hole pressure; and the pressure gauge communicates the lubricant pressure to the controller both while in the gas lift mode and the ESP mode.

15. The assembly according to claim 14, further comprising:

a power cable extending from the controller alongside the production tubing and through the packer to the motor for supplying power to the motor; and wherein the pressure gauge superimposes a signal corresponding to the lubricant pressure on the power cable.

16. The assembly according to claim 13, wherein the tubing valve has a gas lift position that closes a lower end of the production tubing from a discharge of the pump and opens access of well fluid in the lower casing annulus to the lower end of the production tubing.

17. The assembly according to claim 16, wherein the tubing valve has an ESP position that opens the lower end of the production tubing to the discharge of the pump and prevents well fluid in the lower casing annulus from bypassing the intake of the pump and flowing directly into the lower end of the production tubing.

18. The assembly according to claim 13, further comprising:

a discharge pressure gauge between the pump and the tubing valve for sensing a discharge pressure of the pump during the ESP mode and communicating the discharge pressure to the controller, allowing the controller to control a speed of the motor in response to the discharge pressure.

* * * * *